US008355639B2

(12) United States Patent
Paul et al.

(10) Patent No.: US 8,355,639 B2
(45) Date of Patent: Jan. 15, 2013

(54) METHOD FOR COLOR STABILITY DIAGNOSTICS BASED ON CORRELATION ANALYSIS

(75) Inventors: Peter Paul, Webster, NY (US); Palghat Ramesh, Pittsford, NY (US); Eric Michael Gross, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 331 days.

(21) Appl. No.: 12/877,709

(22) Filed: Sep. 8, 2010

(65) Prior Publication Data

US 2012/0057885 A1 Mar. 8, 2012

(51) Int. Cl.
*G03G 15/00* (2006.01)

(52) U.S. Cl. ..... 399/15; 399/49; 399/72

(58) Field of Classification Search ..... 399/9, 15, 399/38, 46, 49, 72, 297, 301, 302, 308; 347/112, 347/115, 116

See application file for complete search history.

(56) References Cited

U.S. PATENT DOCUMENTS 6,804,479 B2 * 10/2004 Kimura ..... 399/49
7,024,152 B2 4/2006 Lofthus et al.
7,136,616 B2 11/2006 Mandel et al.
7,630,672 B2 * 12/2009 Baretsky et al. ..... 399/301
7,783,214 B2 * 8/2010 Itagaki ..... 399/49

OTHER PUBLICATIONS

Palghat Ramesh, U.S. Appl. No. 12/555,308, filed Sep. 8, 2009.

* cited by examiner

*Primary Examiner* — Hoan Tran
(74) *Attorney, Agent, or Firm* — Pillsbury Winthrop Shaw Pittman, LLP

(57) ABSTRACT

A diagnostic method for color stability in an image printing system includes printing a test pattern onto output media; measuring, during the printing of the test pattern, an image of the test pattern on an image transfer surface using one or more image transfer surface sensors to obtain one or more image transfer surface signals; measuring a printed image of the test pattern on the output media using a printed image sensor to obtain a printed image signal; calculating correlation functions for the one or more image transfer surface signals and the printed image signal; and analyzing the correlation functions for the one or more image transfer surface signals and the printed image signal to identify a subsystem in the image printing system that causes variations in color within the plurality of prints of the test pattern.

29 Claims, 10 Drawing Sheets

METHOD FOR COLOR STABILITY DIAGNOSTICS BASED ON CORRELATION ANALYSIS

BACKGROUND

1. Field

The present disclosure relates to a method and a system for color stability in an image printing system.

2. Description of Related Art

An electrophotographic, or xerographic, image printing system employs an image transfer surface, such as a photoreceptor drum or belt, which is charged to a substantially uniform potential so as to sensitize the surface thereof. The charged portion of the image transfer surface is then exposed to a light image of an original document being reproduced. Exposure of the charged image transfer surface selectively discharges the charge thereon in the irradiated areas to record an electrostatic latent image on the image transfer surface corresponding to the image contained within the original document. The location of the electrical charge forming the latent image is usually optically controlled. More specifically, in a digital xerographic system, the formation of the latent image is controlled by a raster output scanning device, usually a laser or LED source.

After the electrostatic latent image is recorded on the image transfer surface, the latent image is developed by bringing a developer material into contact therewith. Generally, the electrostatic latent image is developed with dry developer material comprising carrier granules having toner particles adhering triboelectrically thereto. However, a liquid developer material may be used as well. The toner particles are attracted to the latent image, forming a visible powder image on the image transfer surface. After the electrostatic latent image is developed with the toner particles, the toner powder image is transferred to an output media, such as sheets, paper or other substrate sheets, using pressure and heat to fuse the toner image to the output media to form a print.

The image printing system generally has two important dimensions: a process (or a slow scan) direction and a cross-process (or a fast scan) direction. The direction in which an image transfer surface moves is referred to as the process (or the slow scan) direction, and the direction perpendicular to the process (or the slow scan) direction is referred to as the cross-process (or the fast scan) direction.

The image printing systems may produce color prints using a plurality of stations. Each station has a charging device for charging the image transfer surface, an exposing device for selectively illuminating the charged portions of the image transfer surface to record an electrostatic latent image thereon, and a developer unit for developing the electrostatic latent image with toner particles. Each developer unit deposits different color toner particles on the respective electrostatic latent image. The images are developed, at least partially in superimposed registration with one another, to form a multi-color toner powder image. The resultant multi-color powder image is subsequently transferred to an output media. The transferred multicolor image is then permanently fused to the output media forming the color print.

Color stability continues to be a major print quality issue for the image printing systems. Colors may vary within a page, from page-to-page, from job-to-job, from day-to-day, and from machine-to-machine. Further, determining root causes of color stability problems can be a trial and error procedure for customers and service engineers. Both customers and service engineers often replace many parts of the image printing system searching for the fix to a color stability problem because it can be difficult to determine the root causes of the color stability problem. Because the color stability problems are difficult to isolate, many parts of the image printing system that come back from the field do not exhibit the color stability problem that they were replaced to fix. This results in wastage and additional run cost for the image printing system.

An additional problem that arises is that color stability noises can be both structured and unstructured. The most prominent structured noise is process direction banding, while unstructured noises are those that exhibit statistical independence (are "random").

Banding generally refers to periodic defects on an image caused by a one-dimensional density variation in the process (slow scan) direction. Bands can result due to many different types of variations within components and/or subsystems, such as roll run out (variations in roll or drum diameter) in a developer roll or photoreceptor drum, wobble in the polygon mirror of the laser raster optical scanner (ROS), and the like. Various sources of banding exist in the image printing system and the frequencies of these sources may be known based on the mechanical design of the image printing system.

Distinguishing between the two types of noises (i.e., structured and unstructured) is important because the solution approach to each type of these color stability noises is quite different. For example, banding from multiple simultaneous sources can appear to be unstructured (chaotic), while actually being deterministic.

SUMMARY

According to one aspect of the present disclosure, a computer-implemented diagnostic method for color stability in an image printing system is provided. The method is implemented in a computer system comprising one or more processors configured to execute one or more computer program modules. The method includes printing a test pattern onto output media by forming an image on an image transfer surface and transferring the image on the image transfer surface to the output media; measuring, during the printing of the test pattern, the image of the test pattern on the image transfer surface using one or more image transfer surface sensors to obtain one or more image transfer surface signals; measuring a printed image of the test pattern using a printed image sensor to obtain a printed image signal; calculating correlation functions for the one or more image transfer surface signals and the printed image signal; and analyzing the correlation functions for the one or more image transfer surface signals and the printed image signal to identify a subsystem in the image printing system that causes variations in color within the plurality of prints of the test pattern. The test pattern comprises a plurality of prints and having a predetermined area coverage The image transfer surface signals are representative of a characteristic of the image of the test pattern on the image transfer surface and the printed image signal is representative of a characteristic of the printed image of the test pattern.

According to another aspect of the present disclosure, a diagnostic system for color stability in an image printing system is provided. The system includes a print engine, one or more image transfer surface sensors, a printed image sensor and a processor. The print engine is configured to apply an image of a test pattern to an image transfer surface and transfer the image from the image transfer surface to output media to form a printed image of the test pattern on the output media. The test pattern comprises a plurality of prints and having a predetermined area coverage. The one or more image transfer surface sensors is configured to measure the image of the test pattern on the image transfer surface to obtain one or more image transfer surface signals. The printed image sensor is configured to measure the printed image of the test pattern to obtain a printed image signal. The processor is configured to: a) calculate correlation functions for the one or more image transfer surface signals and the printed image signal; and b) analyze the correlation functions for the one or more image transfer surface signals and the printed image signal to identify a subsystem in the image printing system that causes variations in color within the plurality of prints of the test pattern. The image transfer surface signals are representative of a characteristic of the image of the test pattern on the image transfer surface and the printed image signal is representative of a characteristic of the printed image of the test pattern.

Other objects, features, and advantages of one or more embodiments of the present disclosure will seem apparent from the following detailed description, and accompanying drawings, and the appended claims.

BRIEF DESCRIPTION OF THE DRAWINGS

Various embodiments will now be disclosed, by way of example only, with reference to the accompanying schematic drawings in which corresponding reference symbols indicate corresponding parts, in which.

DETAILED DESCRIPTION

Figure 1:
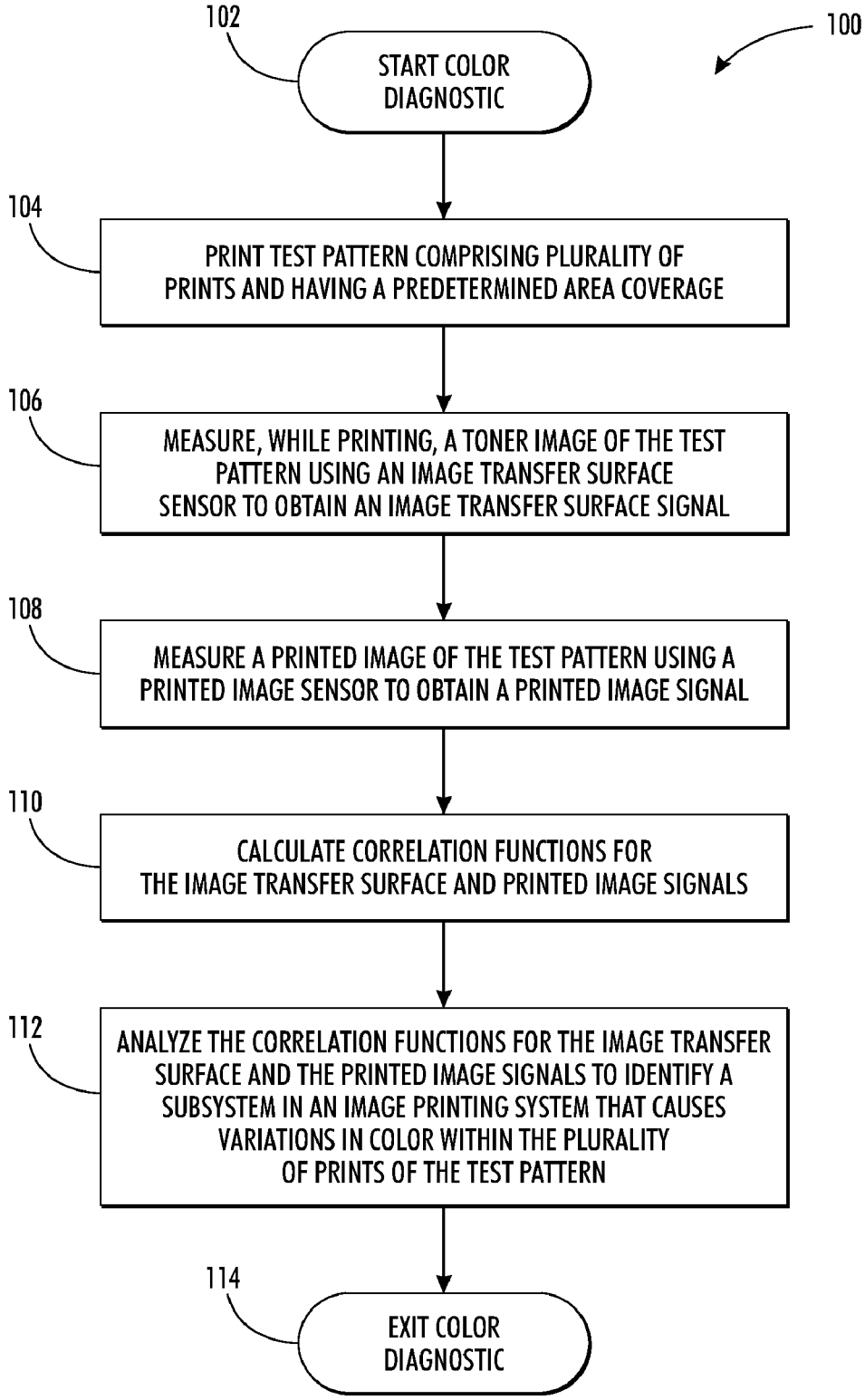
FIG. 1 illustrates a diagnostic method for color stability in an image printing system in accordance with an embodiment of the present disclosure.
Figure 2:
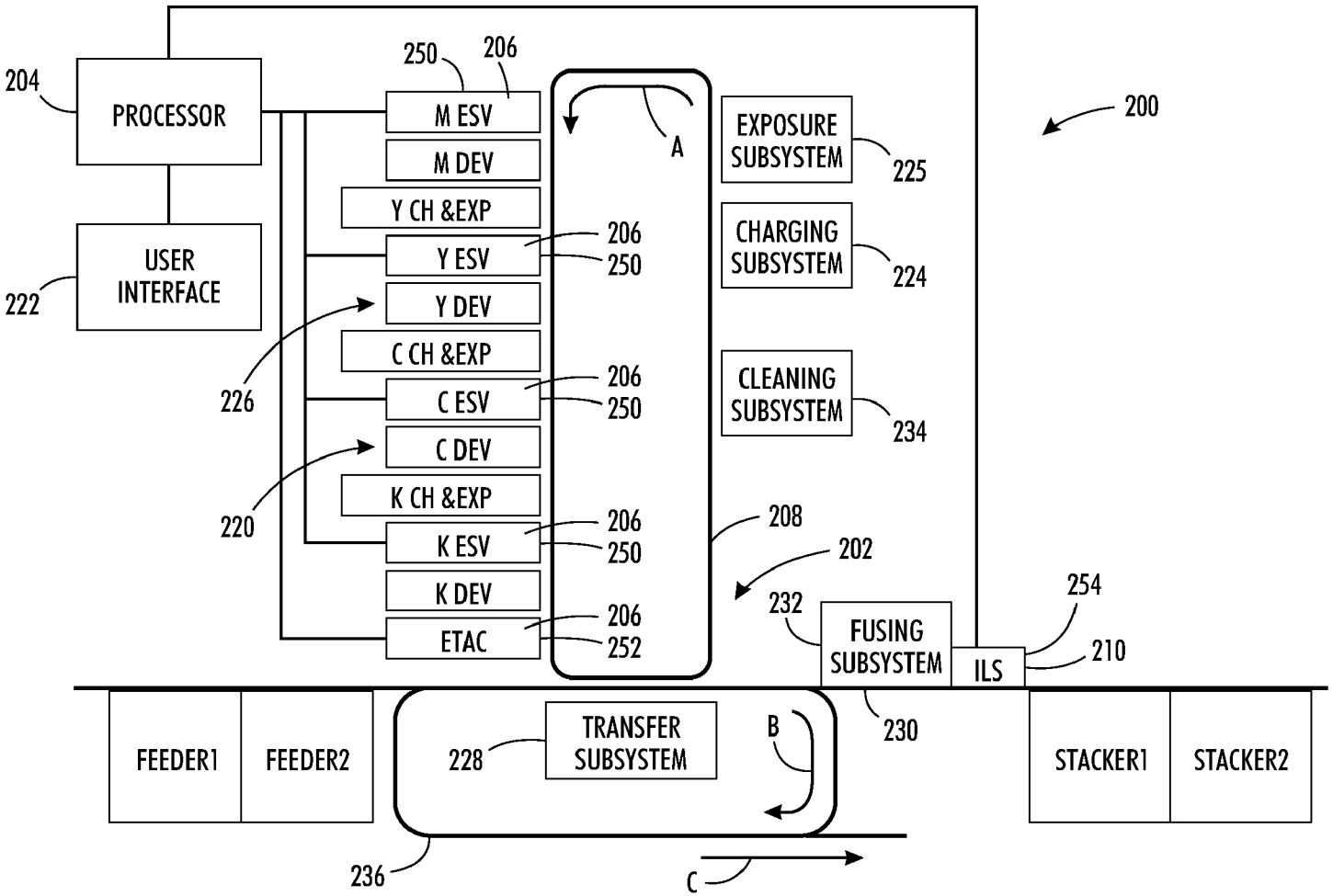
FIG. 2 illustrates a diagnostic system for color stability in the image printing system in accordance with an embodiment of the present disclosure.

A diagnostic method 100 and a diagnostic system 200 for color stability in an image printing system in accordance with an embodiment of the present disclosure are shown in FIGS. 1 and 2, respectively. The diagnostic method 100 systematically isolates color stability problems to their respective root cause subsystem in the image printing system. The method 100 uses existing sensors in the image printing system to measure a diagnostic print job or a test pattern at various stages throughout the printing process. The sensors (e.g., 206 and 210 shown in FIG. 2) are collocated in the cross process direction to allow the same image location to be monitored (by the sensors) at different stages in the electrophotographic process. Time series based correlation analysis techniques are then applied to the data obtained from the sensors. The correlation analysis is performed to determine the amount of output variation (i.e., at various subsystems in the image printing system) that is then correlated to variation(s) seen on a final output print. The correlation coefficients are presented to the user (e.g., a customer or a service engineer). The customer or service engineer examines the subsystems of the image printing system in their most likely order of causing the color stability problem. Further, the system 200 applies a simple rule set to the correlation coefficients to suggest the suspected subsystem(s) causing the color stability problem. The method 100 is also configured to distinguish between banding noises and "random" noises.

FIG. 1 provides the diagnostic method 100 for color stability in the image printing system 202 (as shown in FIG. 2). The method 100 is a computer-implemented method that is implemented in a computer system comprising one or more processors 204 (as shown in and explained with respect to FIG. 2) configured to execute one or more computer program modules.

The method 100 begins at procedure 102. For example, at procedure 102, a customer or a service engineer may begin the diagnostic method 100. At procedure 104, a test pattern comprising a plurality of prints/pages and having a predetermined area coverage is printed. That is, the test pattern is printed onto output media by forming an image on an image transfer surface 208 (as shown in and explained with respect to FIG. 2). The image on the image transfer surface 208 is then transferred to the output media. In one embodiment, all the prints/pages in the test pattern have the same area coverage. The test pattern may include n prints/pages of a mid range halftone target that covers the field of view of all the sensors in the system 200. In one embodiment, the test pattern may include 10-30 pages/prints to capture color stability problems in the image printing system. The color stability in the present disclosure refers to color variation over time, for example, over the n prints/pages in the test pattern.

In one embodiment, the test pattern may include pages/prints at 50% area coverage to capture color stability problems in the image printing system. In other embodiments, the test pattern may include pages/prints at other area coverages such as 25% area coverage or 75% area coverage. As noted above, the plurality of prints/pages (i.e., all the prints/pages) in the test pattern have the same area coverage.

In one embodiment, the prints/pages in the test pattern are full-page, half tone. That is, each print/page in the test pattern is a full page with a block of predetermined area coverage (i.e., making the block either lighter or darker based on the area coverage). In another embodiment, each page/print of the test pattern may include a strip of predetermined area coverage running across the page in the process direction. The location of the strip is predetermined (or prespecified) to coincide with the location of the sensors (e.g., 206 and 210 shown in FIG. 2), and the width of this strip is wide enough (i.e., generally around 15 mm) to cover the depth of field of the sensors. Since all the pages/prints of the test pattern have same area coverage (i.e., lightness and darkness) when printed all the pages/prints of the test pattern should have blocks with the same color (i.e., lighter or darker). But because of the defects in the printing process, color variation between the prints/pages of the test pattern may occur. The method determines where during the printing process such variations occur and thus isolates the source (i.e., subsystem in the image printing system) that is causing such color variations within the test pattern (i.e., over the n prints/pages in the test pattern).

In one embodiment, the block in the print/page (of the test pattern) is further divided into patches. For example, each patch in each block of the print/page is sized and shaped so that a sensor (i.e., an image transfer surface sensor 206 or a printed image sensor 210) of the system 200 can measure color on the patch. For example, an inline spectrophotometer (ILS) sensor 254 (shown and explained with respect to FIG. 2) measures well defined patches that are approximately 15 mm wide in the process direction.

The method 100 then proceeds to procedure 106. At procedure 106, the image of the test pattern on the image transfer surface 208 (as shown in and explained with respect to FIG. 2) is measured using the one or more image transfer surface sensors 206 (as shown in and explained with respect to FIG. 2) to obtain one or more image transfer surface signals. The image transfer surface signals are measured during the printing of the test pattern. The image transfer surface sensors 206 are disposed at a first location (e.g., along the image transfer surface 208) in the image printing system 202, and the image transfer surface signals are representative of a characteristic of the (toner and/or electrostatic) image of the test pattern on the image transfer surface 208.

In one embodiment, the measured image on the image transfer surface 208 may include at least one of an electrostatic charge image post erase and prior to charging, an electrostatic charge image post charging and prior to exposure, an electrostatic charge image post exposure and prior to development, a toner image post development, a toner image post transfer to an intermediate transfer surface, and a residual toner image post transfer to output media.

In one embodiment, the characteristic of the image of the test pattern on the image transfer surface 208 is density of the image of the test pattern. The one or more image transfer surface sensors 206 may include at least one of an enhanced toner area coverage sensor, an electrostatic voltage sensor, a full width array (FWA) sensor, and a residual mass per area (RMA) sensor.

In one embodiment, the image transfer surface sensor 206 is an electrostatic voltage (ESV) sensor 250. When the ESV sensor 250 is used as the image transfer surface sensor 206, the corresponding image transfer surface signal obtained is an actual post-exposure image transfer surface (i.e., photoreceptor (belt or drum)) voltage that is the amount of charge that a developed toner layer imparts to the image transfer surface 208. The actual post-exposure image transfer surface voltage is used to make the output prints.

In one embodiment, the image transfer surface sensor 206 is an extended toner area coverage (ETAC) sensor 252. When the ETAC sensor 252 is used as the image transfer surface sensor 206, the corresponding image transfer surface signal obtained is an actual reflectance of the actual toner or marking material on the image transfer surface 208. For example, the ETAC sensor is configured to measure average optical density level of an imaged area on the image transfer surface 208.

The diagnostic system 200 may include more than one image transfer surface sensor 206. For example, the diagnostic system 200 may include both the ETAC sensor 252 and the ESV sensor 250 as the image transfer surface sensors 206.

The diagnostic system 200 may also include additional sensors (i.e., other than the ESV sensor and the ETAC sensor) to provide the image transfer surface signals. The additional sensors may include a post transfer residual mass per area (RMA) sensor, or a Full Width Array (FWA) sensor that are configured to provide color variations introduced at the transferring step in the printing process. For example, the post transfer residual mass per area (RMA) sensor measures the optical density level of an imaged area on the image transfer surface 208 after the image has been transferred to the output media (e.g., paper). For example, the FWA detects variations in optical density in an imaged area over the full width of the image transfer surface 208.

As noted above, the image transfer surface signals (i.e., for example, the ESV signal, the ETAC signal, etc.) are measured during the printing of the test pattern.

The method 100 then proceeds to procedure 108. At procedure 108, a printed image of the test pattern is measured using the printed image sensor 210 to obtain a printed image signal. The printed image sensor 210 is disposed at a second location (e.g., downstream of the image transfer surface 208) in the image printing system 202 and the printed image signal is representative of a characteristic of the printed image of the test pattern.

The characteristic of the printed image is density of the printed image of the test pattern. The printed image sensor may include at least one of a spectrophotometer, a densitometer, a colorimeter, a spectrometer, and a spectral camera.

In one embodiment, the printed image sensor 210 is the inline spectrophotometer (ILS) sensor 254. When the ILS sensor is used as the printed image sensor, the corresponding printed image signal obtained is the density on the printed image.

Any color variation induced at some stage (e.g., charging, exposure, development, transfer, fusing, etc.) in the printing process is detected using sensors that are disposed downstream (but not upstream) of the corresponding subsystem in the image printing system (i.e., charging subsystem 224, exposure subsystem 225, development subsystem 226, transfer subsystem 228, fusing subsystem 232, etc.) that is causing the color variation.

Once the image transfer surface signals and the printed image signal are obtained, signal conditioning is performed on the image transfer surface signals and the printed image signal. That is, before actually performing the time series analysis algorithms (i.e., correlation functions explained below), the image transfer surface signals and the printed image signal are appropriately filtered and decimated (subsampled). Such signal conditioning (i.e., filtering and subsampling) operations of the sensor signals are known in the art of signal processing, and hence will not be explained here in detail. The filtering and sub-sampling operations are performed on the sensor signals because the sampling rate, the field of view, and the bandwidth of each sensor is different.

The method 100 then proceeds to procedure 110. At procedure 110, correlation functions between the image transfer surface signals and the printed image signal are calculated. These correlation functions include cross-correlation functions for the image transfer surface signals and the printed image signal and auto-correlation functions for the image transfer surface signals and the printed image signal.

The auto-correlation function for the signal from the ESV sensor (or the image transfer surface signal) is calculated using Equation (1):

$$R_{ESV}(\Delta p) = \sum_{ipatch=1}^{npatches-\Delta p} [ESV(ipatch) - m_{ESV}][ESV(ipatch + \Delta p) - m_{ESV}] \quad \text{Equation (1)}$$

where $R_{ESV}$ is an auto-correlation function for the signal from the ESV sensor;

Δp is patch/print lag;

ipatch is the current patch/print in the test pattern;

$m_{ESV}$ is the sample mean of the signal from the ESV sensor;

npatches is the total number of patches/prints in the test pattern; and

ESV is the signal from the ESV sensor.

The auto-correlation function for the signal from the ETAC sensor (or the image transfer surface signal) is calculated using Equation (2):

$$R_{ETAC}(\Delta p) = \sum_{ipatch=1}^{npatches-\Delta p} [ETAC(ipatch) - m_{ETAC}][ETAC(ipatch + \Delta p) - m_{ETAC}] \quad \text{Equation (2)}$$

where $R_{ETAC}$ is an auto-correlation function for the signal from the ETAC sensor;

Δp is patch/print lag;

ipatch is the current patch/print in the test pattern;

$m_{ETAC}$ is the sample mean of the signal from the ETAC sensor;

npatches is the total number of patches/prints in the test pattern; and

ETAC is the signal from the ETAC sensor.

The auto-correlation function for the signal from the ILS sensor (or the printed image signal) is calculated using Equation (3):

$$R_{ILS}(\Delta p) = \sum_{ipatch=1}^{npatches-\Delta p} [ILS(ipatch) - m_{ILS}][ILS(ipatch + \Delta p) - m_{ILS}] \quad \text{Equation (3)}$$

where $R_{ILS}$ is an auto-correlation function for the signal from the ILS sensor;

Δp is patch/print lag;

ipatch is the current patch/print in the test pattern;

$m_{ILS}$ is the sample mean of the signal from the ILS sensor;

npatches is the total number of patches/prints in the test pattern; and

ILS is the signal from the ILS sensor.

The auto-correlation functions (i.e., Equations (1)-(3)) are evaluated for 4=0 to npatches-1. As shown in the Equations (1)-(3), the auto-correlation functions ($R_{ESV}$, $R_{ETAC}$, and $R_{ILS}$) are functions of the patch/print lag (Δp).

The cross-correlation coefficient for the signal from the ESV sensor (i.e., the image transfer surface signal) and the signal from the ILS sensor (i.e., the printed image signal) is calculated using Equation (4):

$$C_{ESV,ILS} = \frac{\sum_{ipatch=1}^{npatches} [ESV(ipatch) - m_{ESV}][ILS(ipatch) - m_{ILS}]}{(npatches - 1) \cdot s_{ESV} \cdot s_{ILS}} \quad \text{Equation (4)}$$

where $C_{ESV,ILS}$ is the cross-correlation coefficient for the signal from the ESV sensor and the signal from the ILS sensor;

ipatch is the current patch/print in the test pattern;

$m_{ESV}$ is the sample mean of the signal from the ESV sensor;

$m_{ILS}$ is the sample mean of the signal from the ILS sensor;

$s_{ESV}$ is the sample standard deviation of the signal from the ESV sensor;

$s_{ILS}$ is the sample standard deviation of the signal from the ILS sensor;

npatches is the total number of patches/prints in the test pattern;

ESV is the signal from the ESV sensor; and

ILS is the signal from the ILS sensor.

The cross-correlation coefficient for the signal from the ETAC sensor (i.e., the image transfer surface signal) and the signal from the ILS sensor (i.e., the printed image signal) is calculated using Equation (5):

$$C_{ETAC,ILS} = \frac{\sum_{ipatch=1}^{npatches} [ETAC(ipatch) - m_{ESV}][ILS(ipatch) - m_{ILS}]}{(npatches - 1) \cdot s_{ETAC} \cdot s_{ILS}} \quad \text{Equation (5)}$$

where $C_{ETAC,ILS}$ is the cross-correlation coefficient for the signal from the ETAC sensor and the signal from the ILS sensor;

ipatch is the current patch/print in the test pattern;

$m_{ETAC}$ is the sample mean of the signal from the ETAC sensor;

$m_{ILS}$ is the sample mean of the signal from the ILS sensor;

$s_{ETAC}$ is the sample standard deviation of the signal from the ETAC sensor;

$s_{ILS}$ is the sample standard deviation of the signal from the ILS sensor;

npatches is the total number of patches/prints in the test pattern;

ETAC is the signal from the ETAC sensor; and

ILS is the signal from the ILS sensor.

After calculating the correlation functions (i.e., the auto-correlation functions using the Equations (1) and/or (2), and (3) and the cross-correlation functions using the Equations (4) and/or (5)), the method 100 then proceeds to procedure 112. At procedure 112, the correlation functions for the image transfer surface signals and the printed image signal are analyzed to identify a subsystem in the image printing system that causes variations in color within the plurality of prints of the test pattern.

In one embodiment, the correlation functions for the image transfer surface signals and the printed image signal are analyzed to identify one or more subsystems in the image printing system that causes variations in color within the plurality of prints of the test pattern. The subsystems of the image printing system that may cause color variations within the plurality of prints of the test pattern may include, for example, the charging subsystem 224, the exposure subsystem 225, the image transfer surface 208, the development subsystem 226, the transfer subsystem 228, the fusing subsystem 232 and/or the cleaning subsystem 234.

Figure 3:
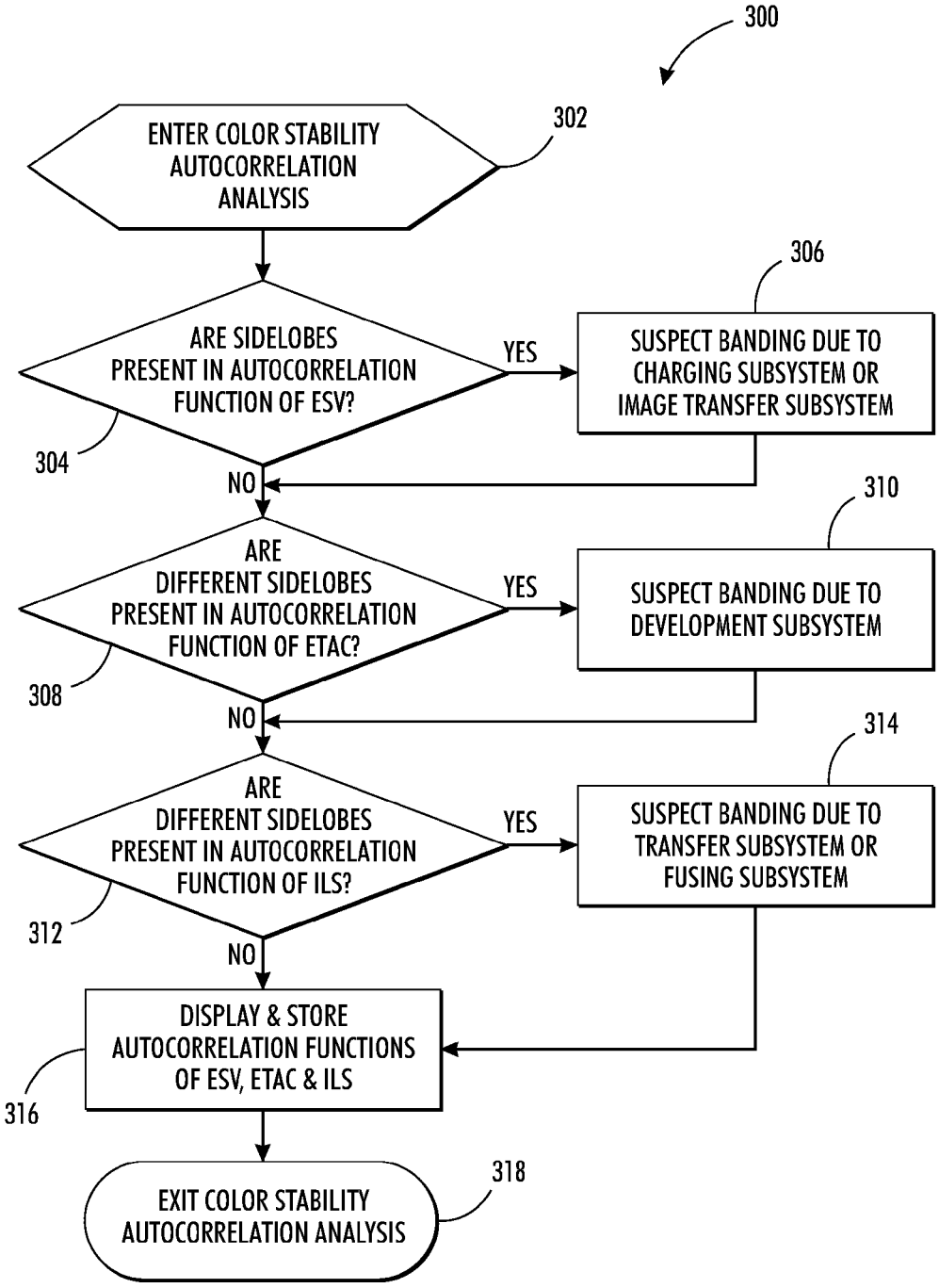
FIG. 3 illustrates a color stability auto-correlation analysis method in accordance with an embodiment of the present disclosure.

The auto-correlation functions (i.e., the Equations (1) and/or (2)) for the image transfer surface signals and the auto-correlation functions (i.e., the Equation (3)) for the printed image signal are analyzed in accordance with a color stability auto-correlation analysis method 300 shown in FIG. 3. The auto-correlation functions for the image transfer surface signals and the printed image signal are particularly well suited to isolate structured noises that cause color stability problems such as process direction banding. The cross-correlation functions for the image transfer surface signals and the printed image signal are analyzed in accordance with a color stability cross-correlation analysis method 400 shown in FIG. 4.

FIG. 3 illustrates the color stability auto-correlation analysis method 300. The method 300 begins at procedure 302. At procedure 304, the processor 204 is configured to analyze the auto-correlation function (i.e., the Equation (1)) of the ESV sensor to determine whether any sidelobes are present in the auto-correlation function of the ESV sensor. The sidelobes are peaks in the auto-correlation function that occur at any non-zero value of the patch/print lag (i.e., Δp). The sidelobes may automatically detected or determined by analyzing the auto-correlation function of ESV sensor, for example, using signal processing techniques. The sample variance is the value of the peak of the auto-correlation function at the patch lag (i.e., Δp) equals zero. The processor 204 is configured to examine the sample variance to determine the overall color variability present at a particular point in the printing process.

If it is determined that the sidelobes are present in the auto-correlation function of the ESV sensor, then the method 300 proceeds to procedure 306. At procedure 306, the banding is suspected due to the charging subsystem 224, the exposure subsystem 225, or the image transfer surface 208. The method 300 proceeds to procedure 308 from the procedure 306.

If it is determined that the sidelobes are not present in the auto-correlation function of the ESV sensor, the method 300 proceeds to the procedure 308 where the processor 204 is configured to analyze auto-correlation function (i.e., the Equation (2)) of the ETAC sensor to determine whether different sidelobes (i.e., different from the sidelobes present in the auto-correlation function of the ESV sensor) are present in the auto-correlation function of the ETAC sensor. If a sidelobe is present in the auto-correlation function of the ESV sensor at a particular value of patch lag (i.e., Δp), then a sidelobe is expected in the auto-correlation function of the ETAC sensor at that same value of the patch lag (i.e., Δp). Therefore, at the procedure 308, the processor 204 is configured to determine whether different sidelobes (i.e., different from the sidelobes present in the auto-correlation function of the ESV sensor) are present in the auto-correlation function of the ETAC sensor.

If it is determined that different sidelobes are present in the auto-correlation function of the ETAC sensor, then the method 300 proceeds to procedure 310. At procedure 310, the banding is suspected due to the development subsystem 226. That is, if the ETAC auto-correlation function exhibits sidelobes at different values of the patch/print lag (i.e., Δp), then additional banding sources are suspected due to the development subsystem 226. The method 300 proceeds to procedure 312 from the procedure 310.

If it is determined that different sidelobes are not present in the auto-correlation function of the ETAC sensor, the method 300 proceeds to the procedure 312 where the processor 204 is configured to analyze auto-correlation function (i.e., the Equation (3)) of the ILS sensor to determine whether different sidelobes (i.e., different from the sidelobes present in the auto-correlation function of the ESV sensor and the sidelobes present in the auto-correlation function of the ETAC sensor) are present in the auto-correlation function of the ILS sensor. If it is determined that different sidelobes are present in the auto-correlation function of the ILS sensor, then the method 300 proceeds to procedure 314. At procedure 314, the banding is suspected due to the transfer subsystem 228 or the fusing subsystem 232. That is, if the ILS auto-correlation function exhibits sidelobes at values of the patch/print lag (i.e., Δp) differing from both the ESV auto-correlation function and the ETAC auto-correlation function, then addition banding sources are suspected due to the transfer subsystem 228 or the fusing subsystem 232. If additional sensors are available at a post transfer location, such as a residual mass per area (RMA) sensor or a post transfer full-width array (FWA) sensor, then a further decomposition between the transfer subsystem and the fusing subsystem may be achieved. The method 300 proceeds to procedure 316 from the procedure 314.

At procedure 316, the auto-correlation functions are displayed on the user interface 222 to a user and are logged/stored.

The patch/print lags at the sidelobes may be related to the banding source frequencies. For example, if Δp is the patch/print lag at the sidelobe peak, then the associated frequency is $v/(\Delta p * I_p)$, where v is the process speed and $I_p$ is the patch length (e.g., 15 mm). In one embodiment, if the system 200 suspects that the banding is present, then the value of the patch/print lag (Δp) corresponding to the sidelobe is compared to a table of known banding source period values to further isolate the problem. However, for detailed banding diagnosis the system 200 or the user may invoke a detailed banding diagnostics routine such as that described in U.S. patent application Ser. No. 12/555,308 filed on Sep. 8, 2009, hereby incorporated by reference in its entirety, and hence will not be explained in detail here. The method 300 ends at procedure 318.

The values of the auto-correlation function at the sidelobes may be used to quantify the contribution of the particular sources to the overall color variation. For example, if $R_1$ is the auto-correlation at sidelobe $\Delta p_1$ then $R_1$ relative to the sample variance (i.e., value of the peak of the auto-correlation function at the patch/print lag (i.e., Δp) equals zero) is the fractional contribution to the overall variance of the source at $\Delta p_1$. Thus, the auto-correlation function may be used to develop a pareto of the contribution from known sources at that point in the printing process. This pareto may be tracked over time to further quantify degradation of components over time, which can be used trigger a service call to replace a specific component.

Figure 4:
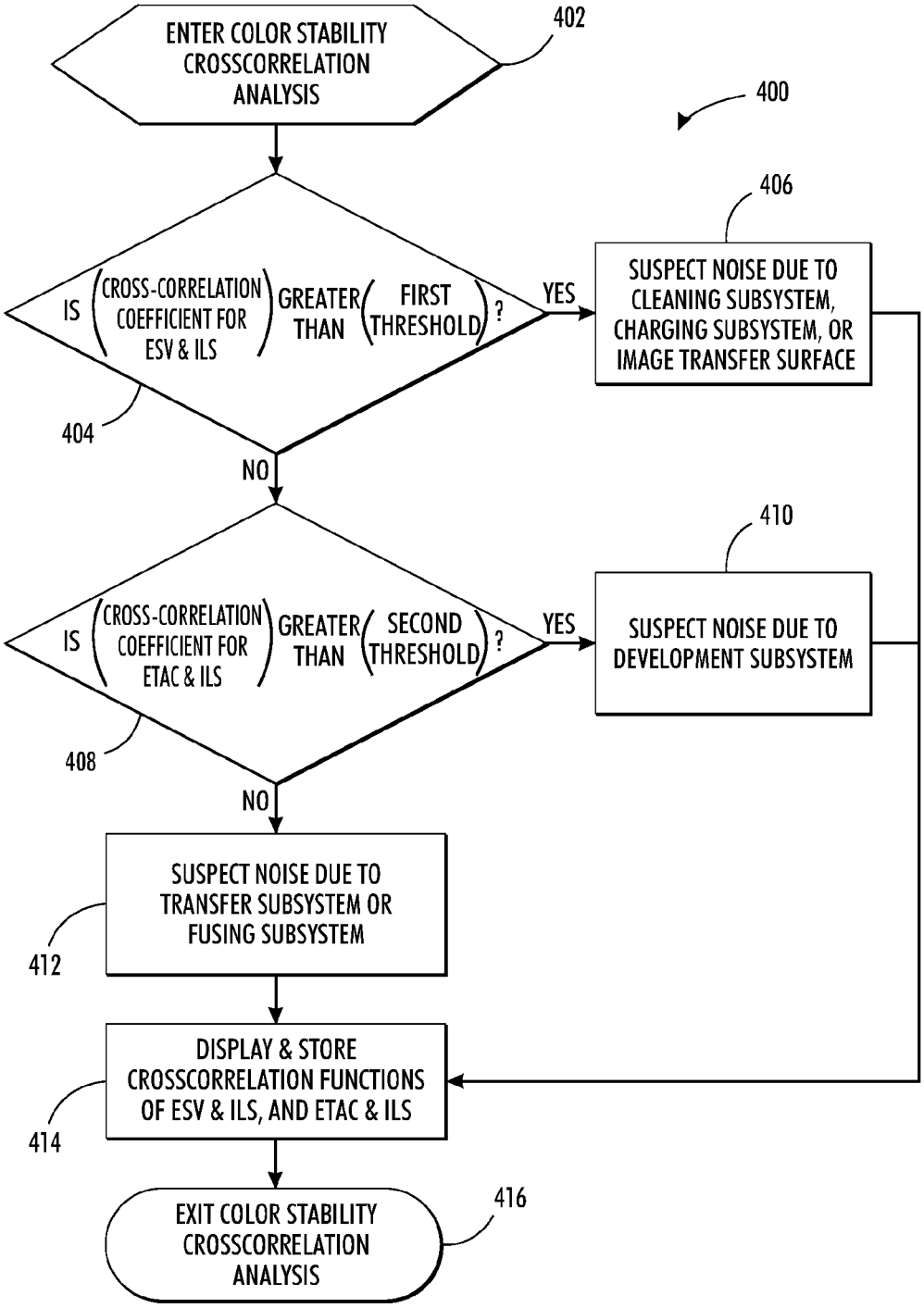
FIG. 4 illustrates a color stability cross-correlation analysis method in accordance with an embodiment of the present disclosure.

FIG. 4 illustrates the color stability cross-correlation analysis method 400. The method 400 begins at procedure 402. At procedure 404, the processor 204 is configured to analyze the cross-correlation function (i.e., the Equation (4)) of the ESV sensor and the ILS sensor to determine whether the cross-correlation coefficient of the ESV sensor and the ILS sensor is greater than a first predetermined threshold. In one embodiment, the first predetermined threshold may be 0.5+/−0.2.

If it is determined that the cross-correlation coefficient of the ESV sensor and the ILS sensor is greater than the first predetermined threshold, then the method 400 proceeds to procedure 406. At procedure 406, the noise is suspected due to the charging subsystem 224, the cleaning subsystem 234, or the image transfer surface 208. That is, if $C_{ESV,ILS}$ is greater than the first predetermined threshold, then the cleaning subsystem 234, the charging subsystem 224, or the image transfer surface 208 is be suspected as the origin of the color stability problem. The method 400 then proceeds to procedure 414 from the procedure 406.

If it is determined that cross-correlation coefficient of the ESV sensor and the ILS sensor is not greater than the first predetermined threshold, then the method 400 proceeds to procedure 408 where the processor 204 is configured to analyze cross-correlation function of the ETAC sensor and the ILS sensor to determine whether the cross-correlation coefficient of the ETAC sensor and the ILS sensor is greater than a second predetermined threshold. In one embodiment, the second predetermined threshold may be 0.5+/−0.2.

If it is determined that the cross-correlation coefficient of the ETAC sensor and the ILS sensor is greater than the second predetermined threshold, then the method 400 proceeds to procedure 410. At procedure 410, the noise is suspected due to the development subsystem 226. That is, if $C_{ETAC,ILS}$ is greater than the second predetermined threshold (while $C_{ESV,ILS}$ is not greater than the first predetermined threshold), then the development subsystem 226 is suspected as the origin of the color stability problem. The method 400 then proceeds to the procedure 414 from the procedure 408.

If it is determined that the cross-correlation coefficient of the ETAC sensor and the ILS sensor is not greater than the second predetermined threshold, then the method 400 proceeds to procedure 412 where the noise is suspected due to the transfer subsystem 228 or the fusing subsystem 232. That is, if neither of the cross-correlation coefficients are greater than their respective thresholds (i.e., $C_{ETAC,ILS}$ is not greater than the second predetermined threshold and $C_{ESV,ILS}$ is not greater than the first predetermined threshold), while the variance of the ILS sensor large, then the transfer subsystem 228 or the fusing subsystem 232 is suspected as the origin of the color stability problem.

If additional sensors are available at a post transfer location, such as a residual mass per area (RMA) sensor or a post transfer full-width array (FWA) sensor, then a further decomposition between the transfer subsystem 228 and the fusing subsystem 232 may be achieved. The method 400 then proceeds to the procedure 414 from the procedure 412.

At procedure 414, the cross-correlation coefficient of (a) the ESV sensor and the ILS sensor and (b) the ETAC sensor and the ILS sensor are displayed on the user interface 222 for the user and are logged/stored. The method 400 ends at procedure 416.

The correlation functions for the image transfer surface signals and the printed image signal are analyzed to distinguish between color stability structured noises and color stability unstructured noises. As noted above, the process direction banding is an example for the color stability structured noise, while a random noise or a noise exhibiting statistical independence is an example for the color stability unstructured noise.

Referring back to FIG. 1, after analyzing the correlation functions (i.e., the auto-correlation functions are analyzed using the method 300 and the cross-correlation functions are analyzed using the method 400) at procedure 112, the method logs/stores the correlation functions, and exits the color stability diagnostics at procedure 114. In one embodiment, the method 100 may further include procedures, such as, displaying, on the user interface 222, the identified subsystem(s) to the user and performing an appropriate maintenance action or service on the identified subsystem(s).

The service engineer may access logs/stored results to service the image printing system. The service engineer may remotely access the logs/stored results even before arriving at the site to service the image printing system. The service engineer may remotely access such logs/stored results to completely resolve the color stability issue without (the service engineer) visiting the site. In addition, such logs may be available to engineering so that population statistics may be obtained for frequency of defects, remedial action taken, and effectiveness. Such data may be extremely useful for field fixes and next generation print engine design.

Figure 10A:
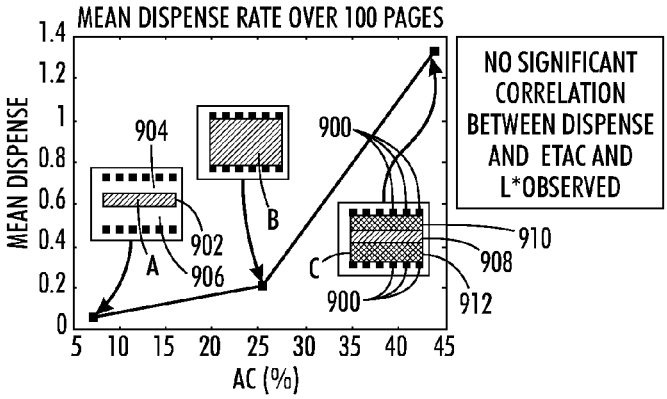
FIGS. 10A-C illustrate the correlation between a developer dispense and a signal from an ETAC sensor and an ILS sensor (i.e., L* signal) in accordance with an embodiment of the present disclosure.
Figure 10B:
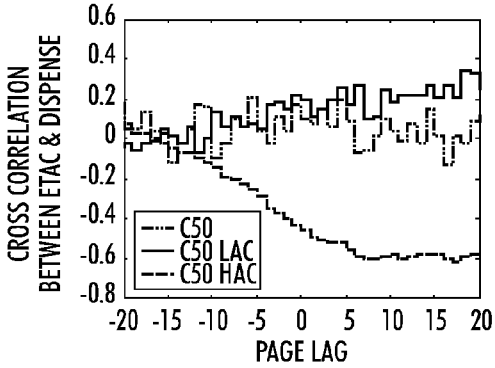
Figure 10C:
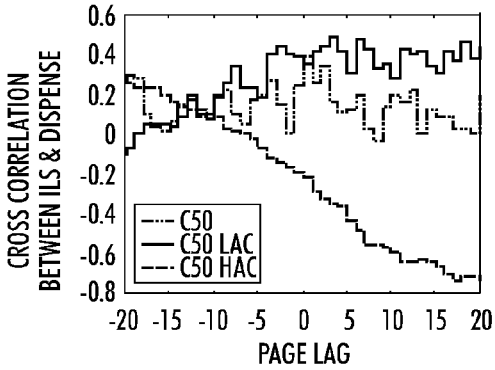

Since the diagnostic method 100 is a statistical correlation based method, actions within the image printing system may also be used to determine significant correlations. For example, a developer dispense in the image printing system was examined in terms of its correlation to color variability. FIGS. 10A-C show how the developer dispense may be correlated to the ETAC signal or the L* signal. As shown and explained below with respect to FIGS. 10A-C, for the data set under consideration, the developer dispense did not cause any significant color stability problems. This may not be the case in other situations (where a different data set is considered). Also, a zero correlation to the output variation is not a bad result in diagnostics. In fact, a zero correlation is an excellent result for low cost maintenance since the zero correlation indicates which subsystem or a set of subsystems is not responsible for the problem. Ruling out possibilities is key to isolating the problem sources.

FIG. 2 illustrates the diagnostic system 200 for color stability in the image printing system 202 in accordance with an embodiment of the present disclosure. The diagnostic system 200 includes a print engine 220, the one or more image transfer surface sensors 206, the printed image sensor 210, the processor 204, and the user interface 222.

The print engine 220 is configured to apply the image of the test pattern to the image transfer surface 208 and transfer the image from the image transfer surface 208 to the output media to form the printed image of the test pattern on the output media. As noted above, the test pattern includes plurality of prints and having a predetermined area coverage.

The image transfer surface 208 rotates in the counter clockwise direction as shown by arrow A in FIG. 2 for the development of a latent image and the transfer of toner from the latent image to the output media, such as sheets, paper or other substrate sheets. The system 200 may also include an intermediate belt for the transfer of toner(s) from the image transfer surface 208 to the output media. The system 200 of the present disclosure may be used with a print engine with or without an intermediate belt.

To generate an output copy of an input document, the image transfer surface 208 is charged using a corona discharger 224 and then exposed to a raster output scanner (laser) 225 to form the latent image on the image transfer surface 208. Toner is applied to the latent image from a developer unit 226. The toner applied to the latent image is transferred to the output media at a transfer station 228. The output media is moved by a transport mechanism 230 to a fuser 232 so that the toner is permanently affixed to the output media.

The print engine 220 may include a digital front end (DFE)/image input terminal (IIT) for preprocessing image input data to generate an image. The image data preprocessing may include generation of the raster scan data that is used by the raster output scanner (ROS) in the exposure subsystem 225 to produce a latent image on the image transfer surface 208 in the print engine 220.

The charging subsystem 224 of the print engine 220 charges a portion of the image transfer surface 208. The exposure subsystem 225 generates a latent image on the image transfer surface 208 that is charged by the charging subsystem 224. The development subsystem 226 applies toner to the latent image on the image transfer surface 208 and the toner is transferred to the output media by the transfer subsystem 228. The transferred toner is fused to the medium sheet by the fusing subsystem 232. The image transfer surface 208 moves through the cleaning subsystem 234 to remove the residual toner particles so that portion of the image transfer surface 208 may be used for development of another latent image.

In FIG. 2, a horizontal loop 236 represents a duplex paper loop 236 that turns in a clockwise direction as represented by an arrow B and the output media moves from left to right (in FIG. 2) as represented by an arrow C.

For each color (e.g., Cyan, Magenta, Yellow and Black) in the image printing system, the ESV sensor, the ETAC sensor, and the ILS sensor capture signals at different points along the printing process. That is, if a defect is detected on the output prints, by careful examination of the sensor signals along the printing process, the subsystem where the defect originates may be determined. By placing additional sensors along the printing process, even more isolation of the defect is possible.

The one or more image transfer surface sensors 206 are configured to measure the image of the test pattern on the image transfer surface 208 to obtain the one or more image transfer surface signals. In one embodiment, the one or more image transfer surface sensors 206 include at least one of an enhanced toner area coverage sensor, an electrostatic voltage sensor, a full width array (FWA) sensor, and a residual mass per area (RMA) sensor. The one or more image transfer surface sensors 206 are disposed at the first location (e.g., along the image transfer surface 208) in the image printing system 202.

In one embodiment, the measured image on the image transfer surface 208 may include at least one of an electrostatic charge image post erase and prior to charging, an electrostatic charge image post charging and prior to exposure, an electrostatic charge image post exposure and prior to development, a toner image post development, a toner image post transfer to an intermediate transfer surface, and a residual toner image post transfer to output media.

The printed image sensor 210 is configured to measure the printed image of the test pattern to obtain the printed image signal. In one embodiment, the printed image sensor 210 includes at least one of a spectrophotometer, a densitometer, a colorimeter, a spectrometer, and a spectral camera. The printed image sensor 210 is disposed at the second location (e.g., downstream of the image transfer surface 208) in the image printing system 202. In one embodiment, the second location (where the printed image sensor 210 is disposed in the image printing system 202) is different from the first location (where the image transfer surface sensor 206 is disposed in the image printing system 202). For optimal signal to noise ratio of the correlation coefficients, the point sensors (e.g., ESV, ETAC, RMA, ILS) are collocated in the cross process direction.

In one embodiment, the processor 204 can comprise either one or a plurality of processors therein. Thus, the term "processor" as used herein broadly refers to a single processor or multiple processors. In one embodiment, the processor 204 can be a part of or forming a computer system. The system 200 may include a memory to store data received and data generated by the processor 204.

The processor 204 is configured to: a) calculate correlation functions for the image transfer surface signals and the printed image signal; and b) analyze the correlation functions for the image transfer surface signals and the printed image signal to identify a subsystem in the image printing system 202 that causes variations in color within the plurality of prints of the test pattern.

The one or more image transfer surface signals is representative of a characteristic of the image of the test pattern on the image transfer surface 208 and the printed image signal is representative of a characteristic of the printed image of the test pattern. In one embodiment, the characteristic of the image of the test pattern on the image transfer surface 208 is density of the toner image of the test pattern, and the characteristic of the printed image of the test pattern is density of the printed image of the test pattern.

The user interface 222 is configured to display the identified subsystem to the user. The user interface 222 may include a graphical user interface. The user interface 222 may be a display device attached to the image printing system 202. This display device may include a cathode ray tube (CRT), a liquid crystal display (LCD), a plasma, or other display device. Alternatively, the user interface 222 may be computer associated with the image printing system 202.

Figure 5:
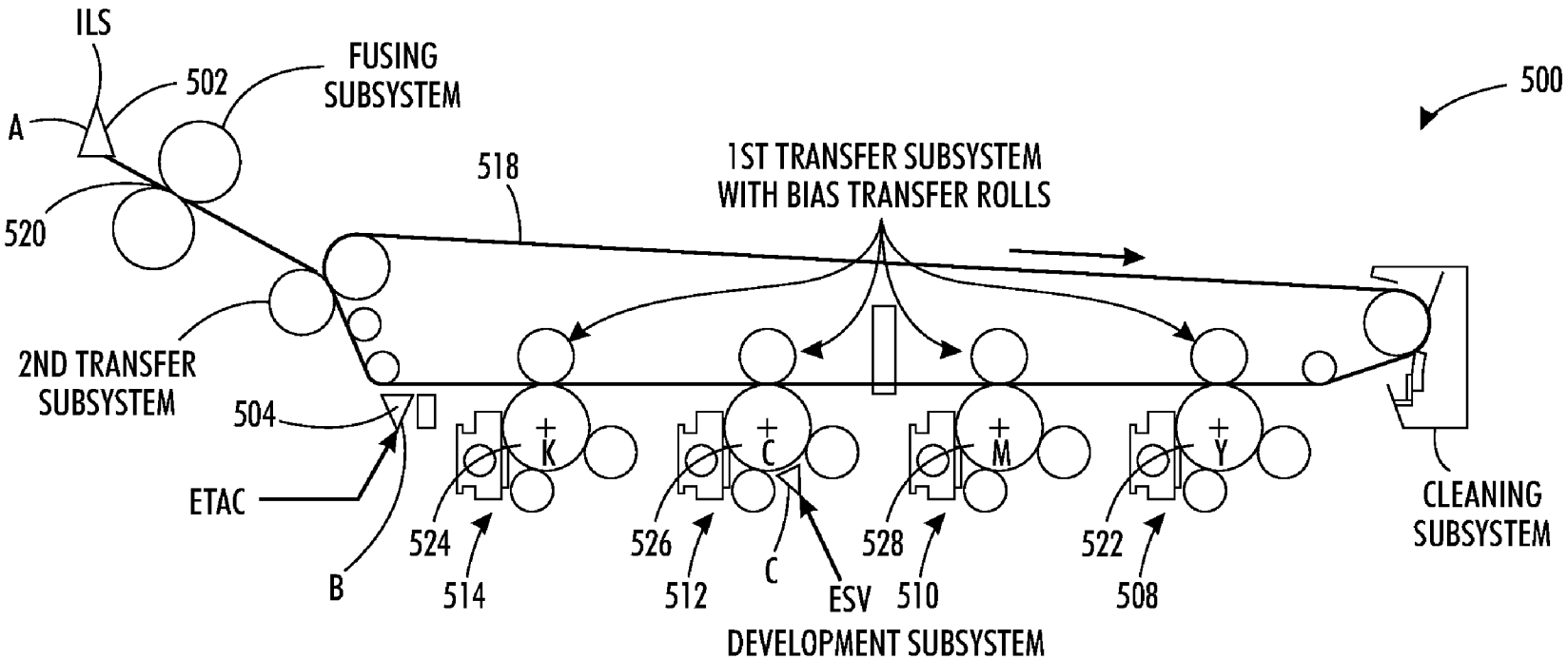
FIG. 5 illustrates an exemplary image printing system showing exemplary locations at which an image transfer surface sensor and a printed image sensor are disposed the image printing system in accordance with an embodiment of the present disclosure.

FIG. 5 illustrates a marking engine architecture for an exemplary image printing system. The exemplary image printing system includes a microtandem color xerographic marking engine. The exemplary image printing system prints and copies at speeds up to 35 ppm color and up to 45 ppm black-and-white. The image transfer surface of this exemplary image printing system is in the form of photoreceptor drums. Four photoreceptor drums (Cyan photoreceptor drum 526, Magenta photoreceptor drum 528, Yellow photoreceptor drum 522, and Black photoreceptor drum 524) are located below intermediate belt 518 with 12 o'clock first transfer geometry. The second transfer is at 9 o'clock.

An ESV sensor 506 is located on the Cyan photoreceptor drum 526 at location C (after the exposure system). An ETAC sensor 504 is mounted in the printing or marking engine at location B (i.e., after all of the marking stations (Cyan marking station 512, Magenta marking station 510, Yellow marking station 508, and Black marking station 514)). The printed images where measured using an offline spectrophotometer 502 disposed at location A in the image printing system. That is, the offline spectrophotometer 502 is disposed downstream of the fusing subsystem 520.

Figure 6A:
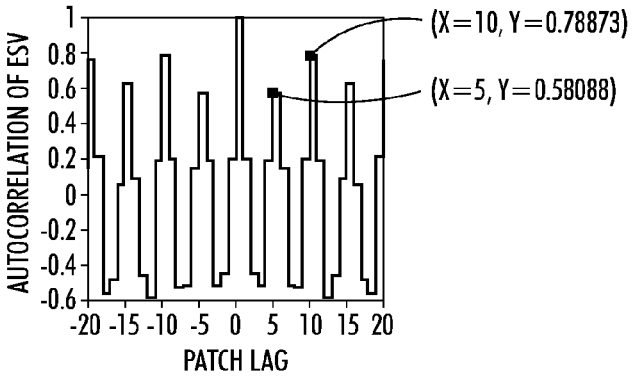
FIGS. 6A-C illustrate exemplary graphical representations of auto-correlation function for ESV sensor, ETAC sensor, and ILS sensor, respectively, in accordance with an embodiment of the present disclosure.
Figure 6B:
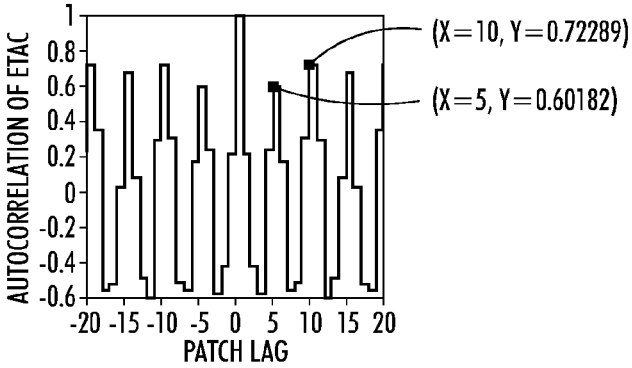
Figure 6C:
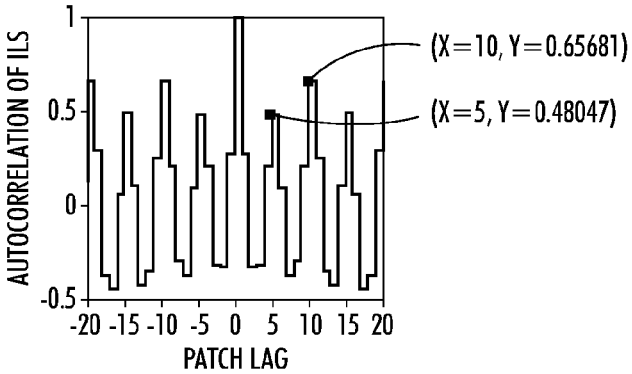

FIGS. 6A-C illustrate exemplary graphical representations of the auto-correlation functions for the ESV sensor, the ETAC sensor, and the ILS sensor, respectively, in accordance with an embodiment of the present disclosure. The exemplary graphical representations of the auto-correlation functions shown in FIGS. 6A-C are for the ESV sensor, the ETAC sensor, and the ILS sensor, respectively, disposed in the exemplary image printing system shown in FIG. 5.

The graph in FIG. 6A illustrates the auto-correlation function for the signal from the ESV sensor (i.e., Equation (1)) on a vertical y-axis, and the patch/print lag (i.e., $\Delta p$) on a horizontal x-axis. The graph in FIG. 6B illustrates the auto-correlation function for the signal from the ETAC sensor (i.e., Equation (2)) on a vertical y-axis, and the patch/print lag (i.e., $\Delta p$) on a horizontal x-axis. The graph in FIG. 6C illustrates the auto-correlation function for the signal from the ILS sensor (i.e., Equation (3)) on a vertical y-axis, and the patch/print lag (i.e., $\Delta p$) on a horizontal x-axis. A test pattern that includes 10 prints/pages is used to generate graphs shown in FIGS. 6A-C. Each print/page in the test pattern includes Cyan color patch with 50% area coverage.

In one embodiment, the patch/print lag (i.e., Δp) may correspond to a characteristic of a component of the image printing system. For example, the patch/print lag (i.e., Δp) of 5 may be related to a diameter of a roll. In other words, the patch/print lag (i.e., Δp) is important in determining which component(s) of the image printing system is causing the color stability problems. In one embodiment, the system 200 may include a table that may provides relationships between the values of the patch/print lag (i.e., Δp) and the component of the image printing system associated with the values of the patch/print lag (i.e., Δp).

In one embodiment, a comparison of y-value in one graph (shown in FIGS. 6A-C) with respect to y-value of another graph (shown in FIGS. 6A-C) provides some indication of what interaction (between the subsystems) in the image printing system is causing the color stability problems.

In one embodiment, structured noises are shown in FIGS. 6A-6C. For such structured noises, if a peak occurs at a patch lag (i.e., Δp) of 5, then peaks are expected to occur at integer multiples of 5 (i.e., 5, 10, 15, 20 . . . ). The peak closest to the patch lag (i.e., Δp) of 0 is used to isolate the sub-system that is causing the color stability problems. For example, in FIGS. 6A-6C, the peak of interest is the peak at the patch lag (i.e., Δp) of 5.

Large sidelobes are present in all three graphs shown in FIGS. 6A-C. This artifact is seen in the ESV auto-correlation function and in all downstream processes (i.e., ETAC auto-correlation function and ILS (on paper) auto-correlation function). These large sidelobes indicate a banding noise source due to the cleaning (or erase) subsystem, the charging subsystem, the exposure subsystem, and/or the image transfer surface. Further, from examining the value of the patch/print lag (i.e., Δp) where the sidelobe peak occurs, the image transfer surface is strongly suspected as a banding noise source causing color stability problems. It is the image transfer surface and how the image transfer surface interacts with the cleaning (or erase) subsystem, the charging subsystem, and the exposure subsystem is suspected as the root cause. By examining the output print or the ETAC signal, the image transfer surface may be suspected due to the strong single frequency of color variation. However, a specific subsystem that the image transfer surface is interacting with in order to cause the problem may not be identified. As explained below, the cross-correlation functions may further be used along with the auto-correlation functions to identify a specific subsystem that is causing the color stability problems.

Figure 7A:
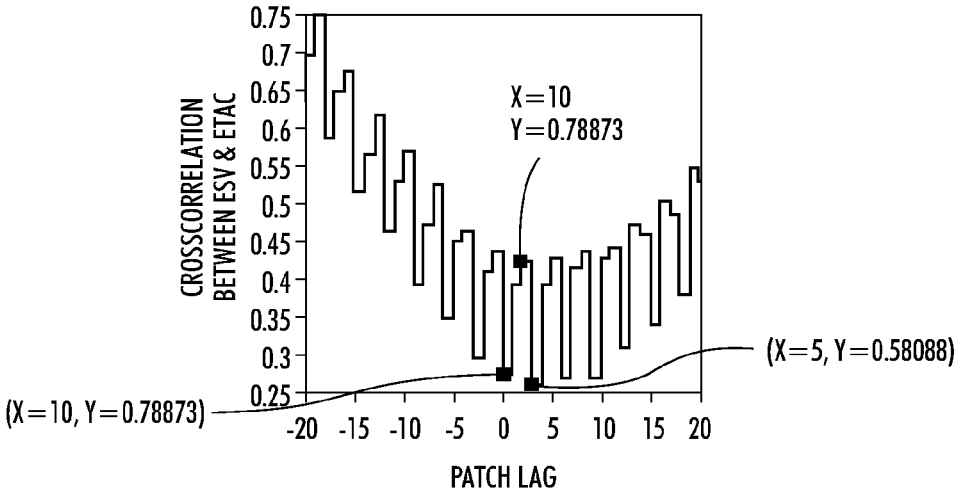
FIGS. 7A-B illustrate exemplary graphical representations of cross-correlation function for (a) ESV sensor and ETAC sensor and (b) ETAC sensor and ILS sensor, respectively, in accordance with an embodiment of the present disclosure.
Figure 7B:
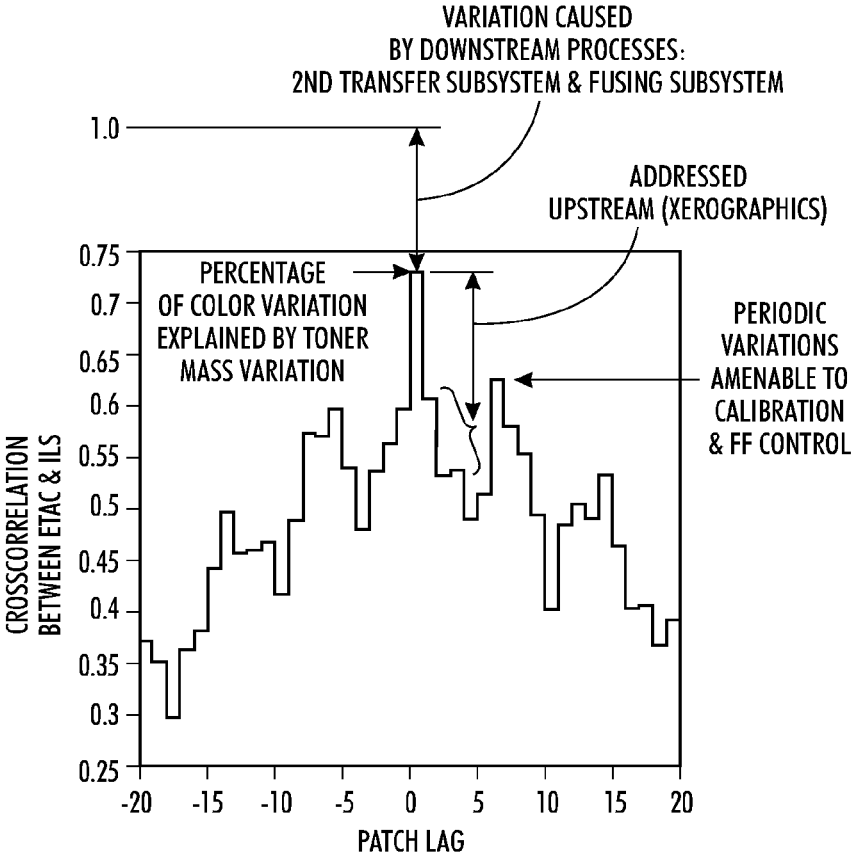

FIGS. 7A-B illustrate exemplary graphical representations of cross-correlation functions for ESV-ETAC sensors and ETAC-ILS sensors, respectively, in accordance with an embodiment of the present disclosure.

The graph in FIG. 7A illustrates the cross-correlation coefficient for the signal from the ESV sensor and the signal from the ETAC sensor on a vertical y-axis, and the patch/print lag (i.e., Δp) on a horizontal x-axis. The graph in FIG. 7B illustrates the cross-correlation coefficient for the signal from the ETAC sensor and the signal from the ILS sensor (i.e., Equation (5)) on a vertical y-axis, and the patch/print lag (i.e., Δp) on a horizontal x-axis.

The peak of the ESV-to-ETAC cross-correlation function is approximately −0.6. This value of the peak of the ESV-to-ETAC cross-correlation function suggests that the cleaning (or erase) subsystem, the charging subsystem, the exposure subsystem, and the image transfer surface account for about 35% (i.e., (square (0.6))*100) of the color variability. The value is negative since the two sensors are anticorrelated. This simply means that the ETAC signal increases when the ESV signal decreases. This can be remedied, if desired, by changing how the signal are defined through simple signal conditioning before calculating the correlation functions. The anti-correlation of the two sensors does not change the values of the auto-correlation functions.

The sidelobes in the ESV-to-ETAC cross-correlation function (shown in FIG. 7A) indicate that some banding may be present. When the circumference of the image transfer surface is not an integer multiple of the patch length (e.g., 15 mm), then the image transfer surface (PR) banding aliases due to the low sampling rate used in the analysis. This phenomena is also present in the autocorrelation sidelobe peaks. Therefore, a more comprehensive banding diagnostic routine such as that described in U.S. patent application Ser. No. 12/555,308 filed on Sep. 8, 2009, hereby incorporated by reference in its entirety, may be invoked if banding is suspected.

Figure 8:
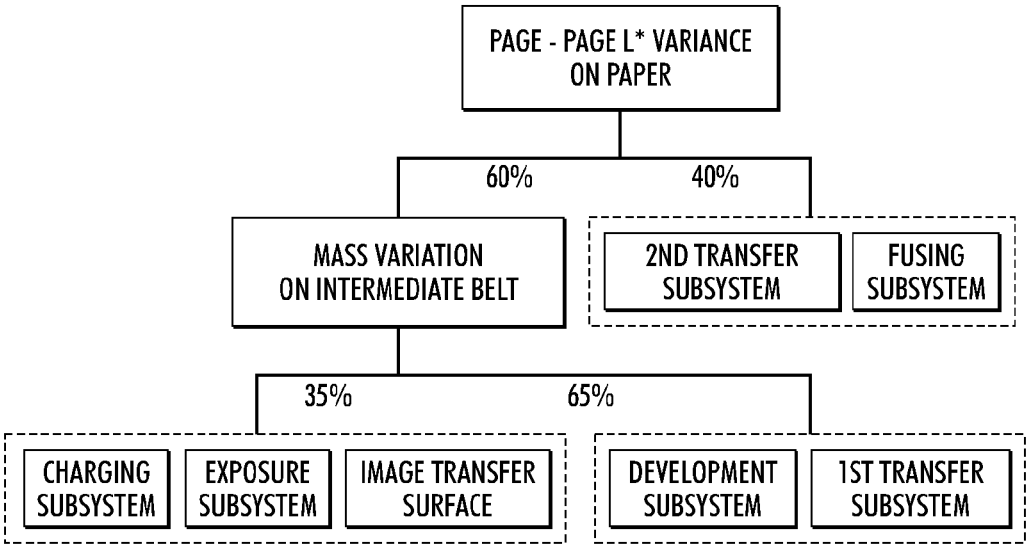
FIG. 8 illustrates an exemplary root cause breakdown of color variability sources (i.e., subsystems in the image printing system) using the cross-correlation analysis in accordance with an embodiment of the present disclosure.

Based on the cross-correlation analysis (shown in FIGS. 7A and 7B), a root cause breakdown of the color variability sources may be constructed as shown in FIG. 8. From the cross-correlation analysis (shown in FIGS. 7A and 7B), the ETAC-to-L* cross-correlation function indicates that about 60% of the color variation originates in subsystems that are disposed prior to second transfer, while about 40% of the color variation is due to the second transfer and the fusing subsystem. The auto-correlation functions of the ETAC sensor may be further used along with the ETAC-to-L* cross-correlation function to identify a specific subsystem that are disposed prior to second transfer that is causing the color stability problems. For example, of the 60% of the color variation that originates in subsystems that are disposed prior to second transfer, about 35% of the color variation originates in the charging subsystem, the exposure subsystem, and the image transfer surface and about 65% of the color variation originates in the development subsystem and the first transfer. Here, the first transfer subsystem includes bias transfer rolls that are configured at the nip interface of the image transfer surface (photoreceptor) and intermediate transfer belt, and the second transfer subsystem includes bias transfer rolls that are configured at the interface of intermediate transfer belt and, for example, paper.

Figure 9A:
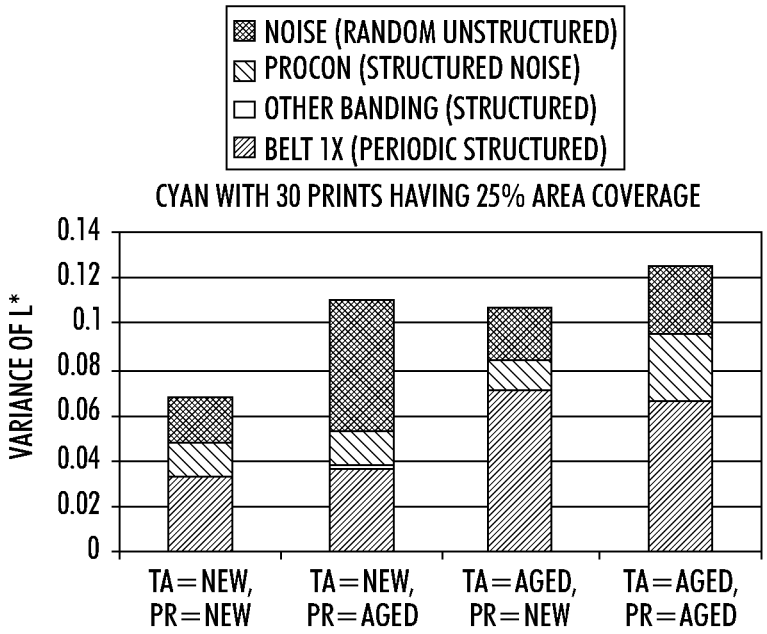
FIGS. 9A-B illustrate exemplary root cause breakdown of color variability sources (i.e., sub-systems in the image printing system) using the auto-correlation analysis in accordance with an embodiment of the present disclosure.
Figure 9B:
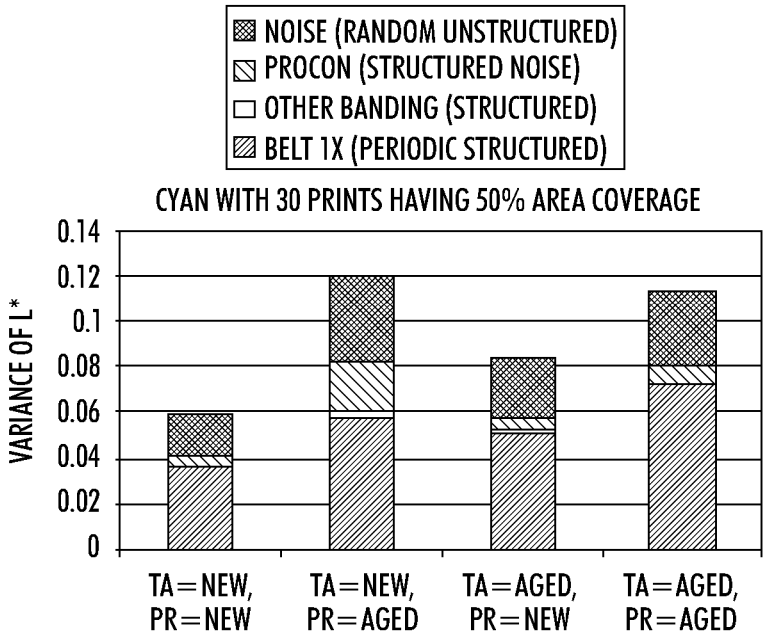

FIGS. 9A and 9B show a similar breakdown (pareto) for the image printing system obtained from the auto-correlation analysis of the ILS sensor (i.e., L*star data). FIG. 9A is a bar graph for the auto-correlation analysis of the ILS sensor for Cyan color when a test pattern having 30 prints and 25% area coverage is used. FIG. 9B is a bar graph for the auto-correlation analysis of the ILS sensor for Cyan color when a test pattern having 30 prints and 50% area coverage is used. The graphs in FIGS. 9A and 9B illustrate the auto-correlation function for the signal from the ILS sensor on a vertical y-axis. On a horizontal x-axis, the bar graphs in FIGS. 9A and 9B illustrate four bars. The first bar represents a case where toner age (effects relative values of components) (TA) is new and the image transfer surface (PR or photoreceptor) is new. The second bar represents a case where toner age (TA) is new and the image transfer surface (PR or photoreceptor) is aged. The third bar represents a case where toner age (TA) is aged and the image transfer surface (PR or photoreceptor) is new. The fourth bar represents a case where toner age (TA) is aged and the image transfer surface (PR or photoreceptor) is new.

Each rectangular bar includes data of a) noises (i.e., random/unstructured color variability noise), b) procon (i.e., structured color variability noises induced by the process control system), and c) banding (i.e., structured color variability noises induced by banding). The structured color variability noises induced by banding may further include 1) banding induced from a specific banding source (e.g., once around of the image transfer surface) and 2) rest of structured color variability noises induced by banding.

The breakdown shown in FIGS. 9A and 9B may be used by service engineers to more accurately service the image printing system. The diagnosis indicates that the image transfer surface is suspected to be causing banding noises and that the development subsystem or first transfer subsystem is suspected of injecting "random" noise into the color stability.

The cross correlation technique described above may also be used to evaluate the impact of external disturbances on color stability. For example, such external disturbances may include temperature, humidity, developer dispense rate, etc.

FIGS. 10A-C show how the developer dispense may be correlated to the signal from the ETAC sensor and the signal from the ILS sensor (i.e., L* signal). That is, the correlation analysis discussed in the present disclosure may also be used to correlate events or actions that are occur in the image printing system to an output print (i.e., the signal from the ILS sensor (i.e., L* signal)). For example, FIG. 10C shows a correlation of dispense action (in the image printing system) and an output print.

The developer dispense is generally used to dispense toner from a storage location. The toner thus dispensed is used by the image printing system to generate an output print. It is generally known that the dispense action in the image printing system may effect the darkness or lightness of the output print.

FIG. 10A illustrates a graphical representation of mean dispense rate over 100 pages versus area coverage. The graph in FIG. 10A illustrates the mean dispense rate in normalized units on a vertical y-axis. On a horizontal x-axis, the graph in FIG. 10A illustrates area coverage as a percentage value.

FIG. 10A shows three Cyan patches A, B and C. The dots 900 shown above and below the patch are used by the sensors to measure the patch properly. Each Cyan patch has a different area coverage. As shown in FIG. 10A, the Cyan patch A has an area coverage of 7%, the Cyan patch B has an area coverage of 25%, and Cyan patch C has an area coverage of 43%.

Referring to the Cyan patch A, a middle strip 902 has a area coverage of 25%. Portion 904 and portion 906 (located above and below the middle strip 902) have an area coverage less than the middle strip 902 such that average area coverage of patch A is 7%. Referring to the Cyan patch C, a middle strip 908 has a area coverage of 25%. Portion 910 and portion 912 (located above and below the middle strip 908) have an area coverage more than the middle strip 908 such that average area coverage of patch C is 43%. The dispense rate is generally regulated by the toner concentration controller, which uses measurement of the toner concentration in the developer sump and the pixel count of the image to set the speed (in rpm) of the dispense motor. As shown in FIG. 10A, in order to obtain these Cyan patches A, B and C, the dispense motor is operated at different mean dispense rate (i.e., 0.075, 0.2 and 1.3).

A relationship between dispense and the signals from the ETAC sensor and from the ILS sensor (i.e., L* signal) is determined and is plotted as shown in FIGS. 10B and 10C.

FIGS. 10B and 10C illustrate graphical representation of the cross-correlation function of the developer dispense and the signal from the ETAC sensor, and the cross-correlation function of the developer dispense and the signal from the ILS sensor (i.e., L* signal), respectively. The graph in FIG. 10B illustrates the cross-correlation function of the developer dispense and the signal from the ETAC sensor on a vertical y-axis, and the page lag on a horizontal x-axis. The graph in FIG. 10C illustrates the cross-correlation function of the developer dispense and the signal from the ILS sensor (i.e., L* signal) on a vertical y-axis, and the page lag on a horizontal x-axis.

Since the correlation coefficients shown in FIGS. 10B and 10C are relatively small in value, and do not exhibit any sharp peaks, it is concluded that for this data set the developer dispense is not causing significant color stability problems. However, this may not be the case in other situations (i.e., for a different data set). As noted earlier, eliminating potential sources (in the image printing system) of color variability is an important strategy to find the actual root cause for color variability.

A relationship between the developer dispense and the signal from the ESV sensor cannot be determined and plotted because the developer dispense is located downstream from the ESV sensor. As noted earlier, any color variation induced at some stage (e.g., charging, development, transfer, fusing, etc.) in the printing process are detected by using sensors that are disposed downstream (not upstream) of the corresponding subsystem in the image printing system (i.e., the charging subsystem, the development subsystem, the transfer subsystem, the fusing subsystem, etc.). The ESV sensor located upstream of the developer dispense and hence cannot be used to detect any color variation caused by the developer dispense.

The method 100 and system 200 are configured to accurately isolate color variability sources. The method 100 and system 200 distinguish between process direction variability sources caused by banding, and those caused by "random" noise.

The method 100 and system 200 also provide a new type of log data that may be mined for improved service and for future product development. The method 100 and system 200 may be applied across a wide range of marking architectures.

The method 100 and system 200 provide a low cost implementation because the system 200 and the method 100 use sensors already existing in the image printing system and actuations that are used to make the print. In other words, the method 100 and the system 200 provide a low cost solution for acquiring diagnostic information, since the method 100 and the system 200 does not require the addition of new sensors to the image printing system.

The correlation methods used in the method 100 and the system 200 are applied for diagnostic use in running machines, for example, by customers or service representatives.

The embodiments described may also be advantageously used for tightly integrated parallel printing (TIPP) systems. Such systems are known where multiple printers are controlled to output a single print job, as disclosed in U.S. Pat. Nos. 7,136,616 and 7,024,152, each of which herein is incorporated by reference in its entirety. In TIPP systems, each printer may have defects in one or more components and/or subsystems that cause color stability problems. The color stability problems for each printer may be estimated using the diagnostic method 100 and the diagnostic system 200 in accordance with the present disclosure.

The color stability diagnostic method 100 uses correlation analysis on sensors and actuators along the print process. The color stability diagnostic method 100 analyzes and compares signals and actuations along the print process (i.e., following the voltage signals and the toner along the print process) to the final output, examines the final output and all the steps along the print process to isolate color stability problems. The color stability diagnostic method 100 also provides a method to generate pareto of contributors to color variability and their relative contributions.

The image transfer surface 208 is at least one of a photoreceptor drum, a photoreceptor belt, an intermediate transfer belt, an intermediate transfer drum, and other image transfer surfaces. That is, the term image transfer surface 208 means any surface on which an image is received, and this may be an intermediate surface (i.e., a drum or belt on which an image is formed prior to transfer to a printed document).

The word "image printing system" as used herein encompasses any device, such as a copier, bookmaking machine, facsimile machine, or a multi-function machine. In addition, the word "image printing system" may include ink jet, laser or other pure printers, which performs a print outputting function for any purpose.

In general, the embodiments described in the present disclosure may be applied to any image printing system where the final output (i.e., printed image) is obtained in a series of sequential procedures, where correlations between measurements of intermediate procedures and measurements of final procedure are used to assess the contribution of the intermediate procedure to the stability of the final output. For example, one or more image transfer surface signals are measured during an initial procedure and/or the plurality of intermediate procedures and the printed image signal is measured during the final procedure. Such image printing systems where the final output (i.e., printed image) is obtained in a series of sequential procedures may include electrophotographic printing systems, direct marking printing systems such as inkjet printing systems and offset printing systems such a lithography.

The system 200 may include a computer network through which documents are (input) received from computers, scanners, and other digital document generators. Also, digital document generators, such as scanner, may be coupled to an image receiver of the system 200.

The term "media," as used herein, may include a sheet of paper, such as a standard 8½×11 inch letter paper, A4 paper, or 8½×14 inch legal paper. However, it will be appreciated that "media" may include other sizes and printable media types, such as, bond paper, parchment, cloth, cardboard, plastic, transparencies, film, foil, or other print media substrates. Any reference to paper is not to be construed as limiting. Different grade and/or gloss media may be used.

Embodiments of the present disclosure, the processor, for example, may be made in hardware, firmware, software, or various combinations thereof. The present disclosure may also be implemented as instructions stored on a machine-readable medium, which may be read and executed using one or more processors. In one embodiment, the machine-readable medium may include various mechanisms for storing and/or transmitting information in a form that may be read by a machine (e.g., a computing device). For example, a machine-readable storage medium may include read only memory, random access memory, magnetic disk storage media, optical storage media, flash memory devices, and other media for storing information, and a machine-readable transmission media may include forms of propagated signals, including carrier waves, infrared signals, digital signals, and other media for transmitting information. While firmware, software, routines, or instructions may be described in the above disclosure in terms of specific exemplary aspects and embodiments performing certain actions, it will be apparent that such descriptions are merely for the sake of convenience and that such actions in fact result from computing devices, processing devices, processors, controllers, or other devices or machines executing the firmware, software, routines, or instructions.

While the present disclosure has been described in connection with what is presently considered to be the most practical and preferred embodiment, it is to be understood that it is capable of further modifications and is not to be limited to the disclosed embodiment, and this application is intended to cover any variations, uses, equivalent arrangements or adaptations of the present disclosure following, in general, the principles of the present disclosure and including such departures from the present disclosure as come within known or customary practice in the art to which the present disclosure pertains, and as may be applied to the essential features hereinbefore set forth and followed in the spirit and scope of the appended claims.

What is claimed is:

1. A computer-implemented diagnostic method for color stability in an image printing system, wherein the method is implemented in a computer system comprising one or more processors configured to execute one or more computer program modules, the method comprising:

printing a test pattern on output media by forming an image on an image transfer surface and transferring the image on the image transfer surface to the output media, the test pattern comprising a plurality of prints and having a predetermined area coverage;

measuring, during the printing of the test pattern, the image of the test pattern on the image transfer surface using one or more image transfer surface sensors to obtain one or more image transfer surface signals, wherein the image transfer surface signals are representative of a characteristic of the image of the test pattern on the image transfer surface;

measuring a printed image of the test pattern using a printed image sensor to obtain a printed image signal, wherein the printed image signal is representative of a characteristic of the printed image of the test pattern;

calculating correlation functions for the one or more image transfer surface signals and the printed image signal; and analyzing the correlation functions for the one or more image transfer surface signals and the printed image signal to identify a subsystem in the image printing system that causes variations in color within the plurality of prints of the test pattern.

2. The method of claim 1, further comprising displaying the identified subsystem to a user.

3. The method of claim 2, further comprising performing service or maintenance of the identified subsystem.

4. The method of claim 1, wherein calculating the correlation functions for the one or more image transfer surface signals and the printed image signal further comprises calculating auto-correlation functions for the one or more image transfer surface signals and the printed image signal.

5. The method of claim 1, wherein calculating the correlation functions for the one or more image transfer surface signals and the printed image signal further comprises calculating a cross-correlation function between the one or more image transfer surface signals and the printed image signal.

6. The method of claim 1, wherein the printed image sensor comprises at least one of a spectrophotometer, a densitometer, a colorimeter, a spectrometer, and a spectral camera.

7. The method in claim 1, wherein the measured image on the image transfer surface comprises at least one of an electrostatic charge image post erase and prior to charging, an electrostatic charge image post charging and prior to exposure, an electrostatic charge image post exposure and prior to development, a toner image post development, a toner image post transfer to an intermediate transfer surface, and a residual toner image post transfer to output media.

8. The method of claim 1, wherein the one or more image transfer surface sensors comprise at least one of an enhanced toner area coverage sensor, an electrostatic voltage sensor, a full width array (FWA) sensor, and a residual mass per area (RMA) sensor.

9. The method of claim 1, wherein the analyzing the correlation functions for the one or more image transfer surface signals and the printed image signal is performed to distinguish between color stability structured noises and color stability unstructured noises.

10. The method of claim 9, wherein the color stability structured noise is a process direction banding.

11. The method of claim 9, wherein the color stability unstructured noise is a random noise or a noise exhibiting statistical independence.

12. The method of claim 1, wherein the printed image is generated in a series of sequential procedures including an initial procedure, a plurality of intermediate procedures and a final procedure.

13. The method of claim 12, wherein the one or more image transfer surface signals are measured during the initial procedure and/or the plurality of intermediate procedures.

14. The method of claim 12, wherein the printed image signal is measured during the final procedure.

15. The method of claim 1, wherein the image printing system is an electrophotographic printing system, an inkjet printing system, or an offset printing system.

16. A diagnostic system for color stability in an image printing system, the system comprising:

a print engine configured to apply an image of a test pattern to an image transfer surface and transfer the image from the image transfer surface to output media to form a printed image of the test pattern on the output media, the test pattern comprising a plurality of prints and having a predetermined area coverage;

one or more image transfer surface sensors configured to measure the image of the test pattern on the image transfer surface to obtain one or more image transfer surface signals, wherein the image transfer surface signals are representative of a characteristic of the image of the test pattern on the image transfer surface;

a printed image sensor configured to measure the printed image of the test pattern to obtain a printed image signal, wherein the printed image signal is representative of a characteristic of the printed image of the test pattern; and a processor configured to:

a) calculate correlation functions for the one or more image transfer surface signals and the printed image signal; and b) analyze the correlation functions for the one or more image transfer surface signals and the printed image signal to identify a subsystem in the image printing system that causes variations in color within the plurality of prints of the test pattern.

17. The system of claim 16, further comprising a display configured to display the identified subsystem to a user.

18. The system of claim 16, wherein the correlation function is an auto-correlation function for the one or more image transfer surface signals and the printed image signal.

19. The system of claim 16, wherein the correlation function is a cross-correlation function between the one or more image transfer surface signals and the printed image signal.

20. The system of claim 16, wherein the printed image sensor comprises at least one of a spectrophotometer, a densitometer, a colorimeter, a spectrometer, and a spectral camera.

21. The system of claim 16, wherein the one or more image transfer surface sensors comprise at least one of an enhanced toner area coverage sensor, an electrostatic voltage sensor, a full width array (FWA) sensor, and a residual mass per area (RMA) sensor.

22. The system of claim 16, wherein the processor is configured to distinguish between color stability structured noises and color stability unstructured noises based on the analysis of the correlation functions.

23. The system of claim 22, wherein the color stability structured noise is a process direction banding.

24. The system of claim 22, wherein the color stability unstructured noise is a random noise or a noise exhibiting statistical independence.

25. The system in claim 16, wherein the image on the image transfer surface comprises at least one of an electrostatic charge image post erase and prior to charging, an electrostatic charge image post charging and prior to exposure, an electrostatic charge image post exposure and prior to development, a toner image post development, a toner image post transfer to an intermediate transfer surface, and a residual toner image post transfer to output media.

26. The system of claim 16, wherein the printed image is generated in a series of sequential procedures including an initial procedure, a plurality of intermediate procedures and a final procedure.

27. The system of claim 26, wherein the one or more image transfer surface signals are measured during the initial procedure and/or the plurality of intermediate procedures.

28. The system of claim 26, wherein the printed image signal is measured during the final procedure.

29. The system of claim 16, wherein the image printing system is an electrophotographic printing system, an inkjet printing system, or an offset printing system.

* * * * *